United States Patent [19]

Rahn

[11] 4,231,853

[45] Nov. 4, 1980

[54] CATHODIC CURRENT CONDUCTING ELEMENTS FOR USE IN ALUMINUM REDUCTION CELLS

[75] Inventor: Henry W. Rahn, Pittsburgh, Pa.

[73] Assignee: PPG Industries, Inc., Pittsburgh, Pa.

[21] Appl. No.: 33,782

[22] Filed: Apr. 27, 1979

[51] Int. Cl.[2] ..... C25C 3/16

[52] U.S. Cl. ..... 204/243 R

[58] Field of Search ..... 204/67, 243 R–247, 204/64 R

[56] References Cited

U.S. PATENT DOCUMENTS

| | | | |
|---|---|---|---|
| 3,156,639 | 11/1964 | Kibby | 204/243 R |
| 3,287,247 | 11/1966 | Dewey | 204/243 R |
| 3,856,650 | 12/1974 | Kugler et al. | 204/243 R |
| 4,071,420 | 1/1978 | Foster, Jr. et al. | 204/243 R X |

*Primary Examiner*—John H. Mack
*Assistant Examiner*—D. R. Valentine
*Attorney, Agent, or Firm*—Edward J. Whitfield

[57] ABSTRACT

A cathode current conducting element for use in a metal e.g. aluminum reduction cell, said element comprising a plate or tile formed of electrically conductive refractory material affixed to the carbon lining of the cell and in loosely restrained engagement therewith by means of a pin embedded in the carbon lining.

7 Claims, 5 Drawing Figures

CATHODIC CURRENT CONDUCTING ELEMENTS FOR USE IN ALUMINUM REDUCTION CELLS

BACKGROUND OF THE INVENTION

Aluminum is typically produced by the Hall-Heroult electrolytic reduction process wherein aluminum oxide dissolved in molten cryolite is electrolyzed at a temperature of from 900° C. to 1000° C. The process is conducted in a pot-type reduction cell which typically comprises a steel shell the interior of which is provided with an insulating lining of a suitable refractory material, which is in turn provided with a lining of carbon, the latter being in contact with the molten constituents. One or more anodes typically made of carbon, connected to the positive pole of a source of direct current are suspended within the cell and one or more iron conductor bars connected to the negative pole of a source of direct current are typically embedded in the carbon lining comprising the floor of the cell causing the carbon lining to become cathodic upon application of current. Molten aluminum is continuously electrolyzed out of the aluminum oxide-cryolite melt and collects on the cathodic carbon floor of the cell and is continuously or periodically withdrawn. A shallow pool or pad of molten aluminum is always maintained on the carbon floor of the cell which molten aluminum pad, since it is in electrical contact with the carbon floor, functions as the active cathodic surface.

Satisfactory electrical conductance between the carbon lining and the molten aluminum pad is hindered by carbon surface effects and by the accumulation of undissolved bath material on the carbon floor of the cell which sludge or muck forms an insulating layer increasing the voltage drop across the cell and lowering its power efficiency.

In order to enhance current conductance from the cathode supply bus to the molten metal pad, electrode elements formed, inter alia, of electrically conductive refractory hard metal have been proposed and are described, for example, in U.S. Pat. No. 3,156,639. It has also been proposed to bond a thin layer of electrically conductive refractory hard metal to the carbon lining as described for example, in U.S. Pat. No. 3,856,650. Furthermore, it is known to line the cell by cementing electrically conductive refractory hard metal tiles to the carbon lining.

However, bonding a layer of electrically conductive refractory hard metal or cementing refractory hard metal tiles to the carbon lining is disadvantageous in that this would not prevent impairment of current conductance to the molten metal pad caused by sludge accumulation and more importantly the refractory hard metal when bonded or cemented to the carbon lining will tend to fracture due to the difference in coefficients of thermal expansion between the refractory hard metal and the carbon.

SUMMARY OF THE INVENTION

In accordance with this invention, shaped articles of electrically conductive refractory hard metal are employed as cathodic current conducting elements in electrolytic metal reduction cells, the shaped articles being in the form of plates or tiles which are affixed to the carbon lining of the cell and held in loosely restrained engagement therewith by means of a pin inserted in the carbon lining.

DESCRIPTION OF THE INVENTION

Figure 1:
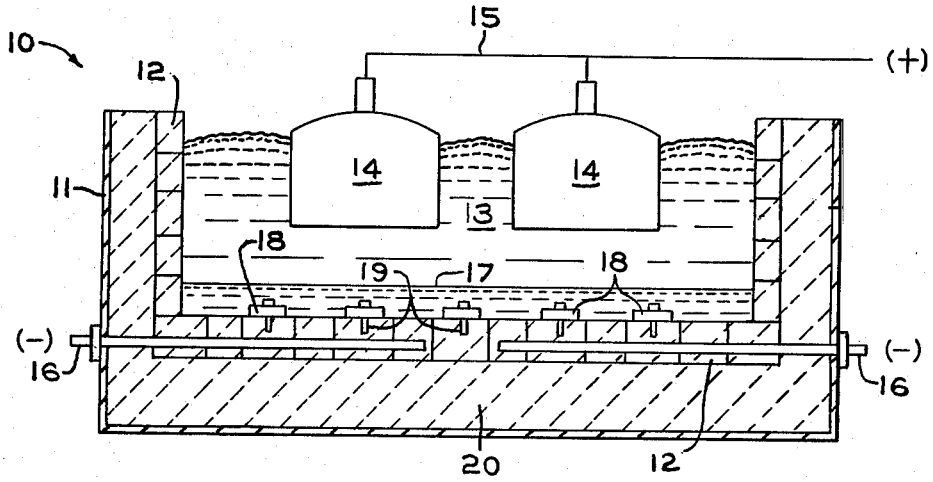
FIG. 1 is a schematic cross-sectional view of a typical pot-type electrolytic aluminum reduction cell provided with cathodic current conducting elements of the invention.

FIG. 1 depicts a typical pot-type electrolytic aluminum reduction cell. Since construction of the cell per se as well as its mode of operation are well known, the same will be described in only general terms to provide basis for a full comprehension and appreciation of the inventive concept herein disclosed.

The cell 10 depicted in FIG. 1 comprises a shell 11, typically of steel, the sidewalls and floor of which are lined with an insulating layer 20 of refractory material which is in turn lined with carbon blocks or bricks 12, defining a chamber or pot containing a molten bath 13 of an aluminum compound, e.g. alumina, dissolved in a molten electrolyte or flux material, e.g. an aluminum fluoride complex commonly referred to as cryolite. Suspended within the pot are one or more anodes, 14 connected to an anode voltage supply bus 15 and disposed within the carbon lining comprising the cathodic floor of the cell are one or more cathode current supply bars 16 connected to the negative pole of a source of direct current. In operation, a shallow pad of molten aluminum 17 is maintained on the floor of the cell the top surface of which pad effectively functions as the active cathodic surface of the cell, current being conducted from the embedded cathode bars 16 through the carbon lining 12 to the molten pad 17, aluminum being electrolyzed out of the molten bath between the anodic and cathodic surfaces. The operating temperature of the cell is typically between 900° C. and 1000° C.

Arrayed on the floor of the cell are a plurality of electrically conductive refractory hard metal plates or tiles 18, each of which being secured to the carbon lining by means of a refractory hard metal pin 19.

The plates and associated pins comprising the cathode current conducting elements of this invention may be formed of any electrically conductive refractory hard metal particularly the carbides and borides of titanium or zirconium. Typically the plates and pins are formed by densifying a finely divided powder of the selected material. Densification may be effected by conventional techniques, e.g. hot pressing or cold pressing and sintering. Of the refractory hard metals, titanium diboride is particularily preferred due to its good electrical conductance, thermal stability, insolubility in and resistance to attack by aluminum, molten cryolite and alumina and its ability to be wetted by molten aluminum.

Figure 2:
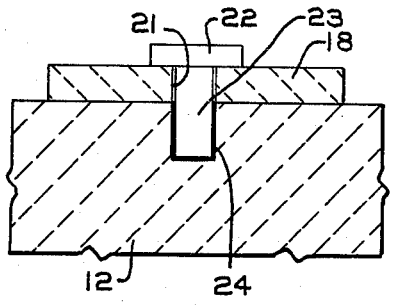
FIG. 2 is an enlarged cross-sectional view of a cathodic current conducting element of the invention showing its mode of attachment to the carbon lining.
Figure 3:
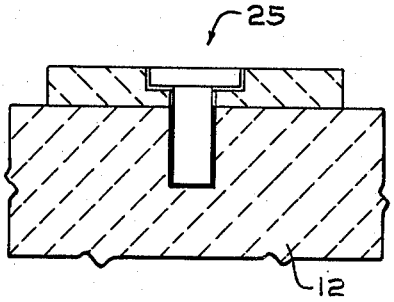
FIG. 3 is an enlarged cross-sectional view of a cathodic current conducting element of the invention showing an alternate mode of attachment to the carbon lining.

As shown in more detail in FIG. 2, the plate is secured to the carbon lining by means of pin 19 which extends longitudinally through an aperture 21 formed in the plate 18, the lower end 23 of the pin being embedded in the carbon lining and secured therein by cementing as at 24. The upper end of the pin is provided with an enlarged head portion 22 having a diameter slightly larger than the aperture in the plate so as to prevent accidental dislodgement of the plate, where, for example, the cell has a sloped floor construction rather than a flat floor. If desired the pin may be counter sunk in the plate as illustrated at 25 in FIG. 3. Since, according to the invention, the plate is not integrally bonded or cemented to the carbon lining, but is held in loosely restrained engagement with the carbon lining by means of the pin, the plate is free to expand and contract independently of the carbon lining caused by temperature fluctuations in the cell; thus precluding fracturing or cracking of the plate due to differences in the coefficients of thermal expansion between the refractory hard metal and carbon as would be the case were the plate bonded or cemented to the carbon lining.

Although in the embodiment of the invention discussed hereinabove and illustrated in the drawings the pin is permanently imbedded in the carbon lining by cementing, it is also contemplated that in the broadest aspects of this invention the pin may be loosely inserted into a corresponding aperature formed in the carbon substrate. Alternatively the pin may be secured to the carbon substrate by threaded engagement although such a means of engagement might be prohibitive from a cost standpoint. Moreover the pins need not be provided with an enlarged head portion in for example the case where only lateral movement of the plate need be restrained.

Obviously, if the floor of the cell were substantially flat, the plates could simply be placed directly on the floor and apparently would need not be secured thereto by any means. Further, in this regard, one could, for example, simply distribute regularly or irregularly shaped articles of titanium diboride on the floor of the cell, e.g., bricks, spheres, or even rubble.

However, the use of plates secured in accordance with this invention affords an advantage that does not inure when the plates are simply placed directly on the floor of the cell. A common problem encountered in aluminum reduction cells is caused by sludging or mucking wherein undissolved particles in the molten bath settle out of the melt through the aluminum pad and form a layer on the floor of the cell. This layer of sludge or muck is electrically non-conductive and exerts an insulating effect, thus reducing the efficiency of current flow from the carbon to the aluminum pad.

However, since the pin connector extends into the carbon lining, regardless of the extent of mucking, the shaft of the pin embedded in the carbon lining is unaffected by muck accumulation, and provides an uninterrupted path for the flow of electrical current from the cathode supply bars to the plate and thence to the aluminum pad.

The plates may be arrayed on the floor of the cell in any desirable configuration. In order to further enhance uniform electrical conductance through the cell, the plates may be arrayed on the sidewalls of the cell as well. Moreover, there is no particular limitation regarding the dimensions or geometry of the plates, e.g., they may be regularly shaped, e.g. square, oblong, circular, triangular, or irregularly shaped and may be affixed to the carbon lining by more than one pin connector.

Since refractory hard metals, e.g. titanium diboride are expensive materials, the plates need not be solid, but may be perforated in order to save on use of material. Moreover, the plates may be sized such as they are submerged in the aluminum pad or their upper surfaces may extend in the cryolite layer in which latter case the plates themselves would effectively function as active cathodic surfaces.

Figure 4:
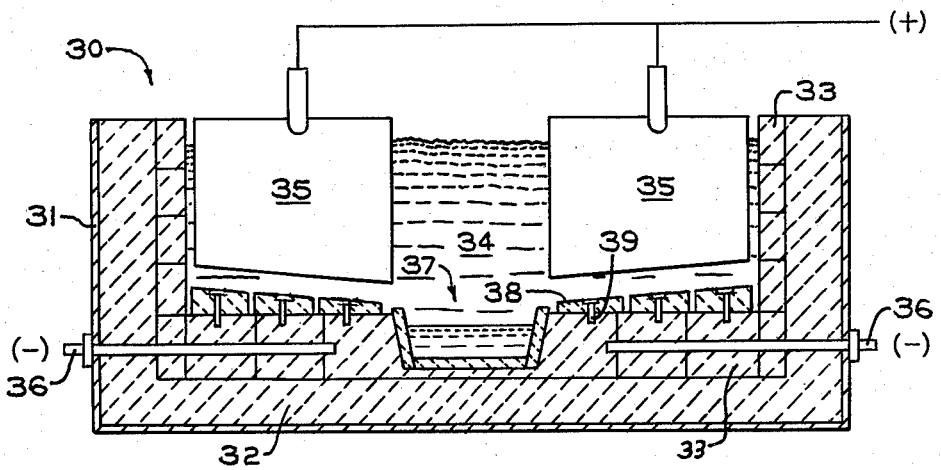
FIG. 4 is a schematic cross-sectional view of an alternative design of an aluminum reduction cell provided with cathodic current conducting elements of the invention.

Another embodiment of the invention wherein the top surfaces of the plates themselves function as active cathodic surfaces is depicted in FIG. 4. In like manner to the cell 10, depicted in FIG. 1 the cell 30 shown in FIG. 4 comprises a steel shell 31, the floor and sidewalls of which are lined with an insulating layer 32 of refractory material which is overlaid with a lining 33 of carbon block or bricks, defining a chamber containing a molten bath 34 of alumina dissolved in cryolite. Suspended within the chamber are one or more anodes 35 and disposed within the carbon lining comprising the floor of the cell are one or more cathode current supply bars 36.

An open channel or trough 37 is formed in the carbon lining of the floor of the cell which divides the cell into symmetrical portions, which channel serves to convey molten aluminum metal out of the cell. Operation of the cell is as previously described, i.e. molten aluminum is electrolyzed out of the molten bath between anodic and cathodic surfaces.

However in the embodiment of the invention depicted in FIG. 4, the active cathodic surface of the cell is provided by a plurality of the cathode current conducting elements of this invention, ie., plates or tiles 38 secured to the carbon lining of the floor of the cell by pin means 39 as previously described.

Figure 5:
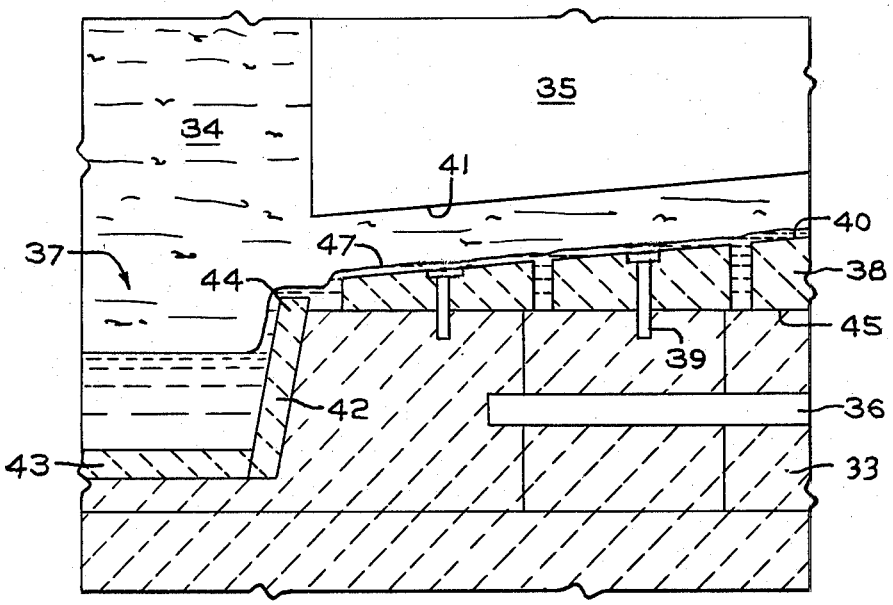
FIG. 5 is an enlarged fragmentary view of a portion of the cell depicted in FIG. 4.

As shown in more detail in FIG. 5, a plurality of plates 38 arranged in tiers are provided, each plate having a flat bottom surface 45 and a sloped top surface 40 said top surfaces 40 sloping in the direction of the trough 37. The vertical dimensions of the plates comprising each tier are sized such that the top surfaces of the plates all lie substantially in the same plane which is parallel to and in spaced relationship from the corresponding sloped undersurface 41 of anode 35. Preferably the heads of the pin connectors are countersunk into the tops of the plates so as to present a substantially smooth, uninterrupted, cathodic surface. The plates are mounted in sufficiently close proximity to each other so as to impede substantial rotational movement about the vertical axis of the pin, but the plates should not be mounted in such close proximity to prevent free expansion.

The sloped top surfaces 40 of plates 38 extend into the molten bath 34 and molten aluminum is electrolyzed out of the bath between the undersurface of the anode and the top surfaces of the plates and forms in a thin layer 47 on the surfaces of the plates and flows toward and into the trough by which the molten aluminum is conveyed out of the cell.

Since titanium diboride, of which the plates are preferably fabricated, in addition to its other desirable properties enumerated hereinabove, is readily and easily wetted by molten aluminum, the molten aluminum will not tend to "ball-up" on the surface of the plates as it is formed but will form in a smooth thin, film, which permits desirably close spacing between the active anodic and cathodic surfaces. The side walls and floor of the trough are also preferably lined with titanium diboride as at 42 and 43.

Although a pad of molten aluminum is maintained on the carbon floor of the cell to protect the carbon from attack by the molten cryolite, the depth of this pad is controlled so as not to cover the top surfaces of the plates. The depth of the pad may be conveniently controlled by the provision of a weir extending londitudinally of the trough. As shown in FIG. 5, the weir 44 may be an extension of the lining of the side wall of the trough.

Although the cell shown in FIG. 4 illustrates a trough dividing the cell into two symmetric sections it is to be understood that, depending on the size of the cell, more than one trough could be provided.

It is to be further understood that the interface between the carbon floor and the undersurfaces of the plates is not perfectly smooth as depicted in the drawing, but rather the carbon floor is typically irregular and convoluted. Consequently, in practice, molten metal will tend to creep beneath the plates, and in addition will fill the annular space between the plate and the loosely fitting pin connector, which is by no means detrimental but rather serves to enhance electrical contact and serves to further reduce voltage losses between the cathode current supply means and the active cathodic surfaces.

Although the invention has been described herein, with particular reference to preferred embodiments, thereof, it is apparent that many variations may be made by those skilled in the art without departing from the spirit and scope of the invention. For example, the cathode current conducting elements of the invention may be employed in any molten metal production process wherein a metal compound or a metal compound dissolved in a molten solvent is electrolyzed between anodic and cathodic surfaces.

I claim:

1. In an electrolytic metal reduction cell wherein molten metal is produced by electrolyzing between active anodic and cathodic surfaces a compound of the metal dissolved in a molten solvent said molten metal collecting in a pad on the floor of the cell said cell comprising carbon-lined side walls and a floor defining a chamber containing the molten constituents, anode means suspended in said chamber, cathode current supply means imbedded in the carbon lining by which electric current is conducted from the cathode current supply means through the carbon lining to the pool of molten metal, the improvement residing in the provision of means for reducing the voltage loss from the cathode current supply means to the active cathodic surface said means provided by at least one plate or tile-shaped element held in loosely restrained physical engagement with the surface of the carbon lining of the floor of the cell by means of at least one pin, said pin extending through an aperture formed in said plate or tile, the lower end of said pin being inserted in the carbon lining thereby restraining lateral movement of said plate or tile with respect to the vertical axis of the pin said plate or tile and associated pin being formed of an electrically conductive refractory hard metal.

2. The improvement of claim 1 wherein that portion of the pin inserted in the carbon lining is secured thereto by cementing or threaded engagement.

3. The improvement of claim 1 wherein the plate or tile and associated pin are formed of a material selected from the carbides or borides of titanium or zirconium.

4. The improvement of claim 3 wherein the material from which the plate or tile and associated pin are formed is titanium diboride.

5. The improvement of claim 1 wherein the top surface of the plate or tile is covered by the molten metal pad, whereby the surface of the molten metal pad serves as the active cathodic surface.

6. The improvement of claim 1 wherein the top surface of the plate or tile protrudes into the molten solvent whereby the top surface of the plate serves as the active cathodic surface.

7. The improvement of claim 1 wherein the plate or tile-shaped element defined therein is used in conjunction with an electrolytic aluminum reduction cell.

* * * * *